US006221181B1

(12) United States Patent
Bossmann et al.

(10) Patent No.: US 6,221,181 B1
(45) Date of Patent: Apr. 24, 2001

(54) COATING COMPOSITION FOR HIGH TEMPERATURE PROTECTION

(75) Inventors: Hans-Peter Bossmann, Wiesloch; Hans J. Schmutzler, Maikammer; Marianne Sommer, Sandhausen; Christoph Sommer, Plankstadt, all of (DE); Maxim Konter, Klingnau (CH); Peter Holmes, Winkel (DE); Christoph Toennes, Brugg (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/388,275

(22) Filed: Sep. 1, 1999

(30) Foreign Application Priority Data

Jun. 2, 1999 (WO) ..... PCT/EP99/03833

(51) Int. Cl.[7] ..... C22C 19/05

(52) U.S. Cl. ..... 148/428; 148/442; 148/410; 420/445; 428/680

(58) Field of Search ..... 148/428, 442, 148/410; 420/445; 428/680

(56) References Cited

U.S. PATENT DOCUMENTS

| | | | | |
|---|---|---|---|---|
| 4,124,737 | * | 11/1978 | Wolfla et al. | 428/640 |
| 4,339,509 | * | 7/1982 | Dardi et al. | 428/632 |
| 4,419,416 | * | 12/1983 | Gupta et al. | 428/656 |
| 4,447,503 | * | 5/1984 | Dardi et al. | 428/632 |
| 4,758,480 | * | 7/1988 | Hecht et al. | 428/680 |

* cited by examiner

*Primary Examiner*—Roy V. King
*Assistant Examiner*—Nicole Coy

(57) ABSTRACT

The invention relates to a coating composition for superalloy structural parts, especially for gas turbine vanes and blades, which provides simultaneously excellent environmental resistance and highly improved thermomechanical behavior. The coating consists essentially of, by weight, 28–35% Co, 11–15% Cr, 10–13% Al, 0–1% Re, 1–2% Si, 0.2–1% Ta, 0.005–0.5% Y, 0–5% Ru, 0–1% Ca, 0–1% Mg, 0–0.5% La (or elements from the La series), 0–0.1% B, balance Ni and incidental impurities.

14 Claims, 3 Drawing Sheets

COATING COMPOSITION FOR HIGH TEMPERATURE PROTECTION

BACKGROUND OF THE INVENTION

1. Field of the Invention

The invention relates to an improved class of protective coatings for use on superalloy articles, such as gas turbine rotating blades and stationary vanes.

Wide use of single crystal (SX) and directionally solidified (DS) hot-stage components has allowed increased turbine inlet temperature and therefore turbine efficiency. The improvement in high-temperature strength of these new superalloys involved an increased susceptibility of the alloy to sulfidation and oxidation. To restore environmental resistance to engine parts made from DS and SX alloys requires a new generation of high-temperature resistant coatings. Historically, aluminide or MCrAlY coatings (where M represents a transition element such as Ni, Co, Fe or mixtures thereof) have been applied by engine manufacturers to extend the useful life of hot section components.

Due to their limited thickness (typically around 50 ~$\mu$m) aluminide coatings do not offer sufficient oxidation and corrosion protection for the long exposure times in stationary gas turbines (20000–50000 hours). Present MCrAlY coatings, in particular when the Al reservoir phase consists of β (NiAl) phase demonstrate much greater environmental resistance compared to aluminide coatings. However, since a coated turbine blade undergoes complicated stress states during engine operation (especially during start up and shut down) advanced high temperature coatings must not only provide environmental protection but must also have specifically tailored physical and mechanical properties to provide high thermo-mechanical fatigue resistance. In summary, high-temperature resistant coatings must meet the following requirements:

- high oxidation resistance
- slowly growing oxide scale and good oxide scale adherence
- hot corrosion resistance, superior to SX/DS superalloys
- low interdiffusion of Al and Cr into the substrate to prevent the precipitation of brittle needle-like phases under the coating
- high thermo-mechanical fatigue resistance U.S. Pat. Nos. 5,273,712 and 5,154,885 disclose coatings with significant additions of Re which simultaneously improves creep and oxidation resistance at high temperatures. However, the combination of Re with high Cr levels, typical for traditional coatings, results in an undesirable phase structure of the coating and interdiffusion layer. At intermediate temperatures (below 950–900° C.), α-Cr phase is more stable in the coating than the γ-matrix. This results in low toughness and low ductility. In addition, a significant excess of Cr in the coating compared to the substrate results in diffusion of Cr to the base alloy, which enhances precipitation of needle-like Cr-, W- and Re-rich phases.

U.S. Pat. No. 4,447,503 discloses a superalloy coating composition with high temperature oxidation resistance. The coatings consist essentially of, by weight, 5–50% Cr, 3–30% Al, 0.01–15% Ta, up to 10% Mn, up to 5% W, up to 12% Si, up to 10% Hf, up to 5% reactive metal from the group consisting of La, Y, and other rare earth (RE) elements, up to 5% of RE and/or refractory metal oxide particles, and the balance selected from the group consisting of Ni, Co and Fe, and combinations thereof. Additions of up to 5% Ti and up to 15% noble metals are also contemplated. However, the coatings are only intended for applications where the need for improved high temperature oxidation is paramount and where the coating ductility is relatively unimportant.

OBJECT OF THE INVENTION

It is an object of the present invention to provide an improved coating for structural parts of gas turbines which exhibits improved-mechanical behavior.

It is another object of the present invention to provide an improved coating for structural hot-stage components of gas turbines that operate in high temperature oxidizing and sulfidizing environments.

It is a further object of the present invention to provide an improved coating with sufficient oxidation and corrosion resistance and diffusional stability for the long exposure times customary in stationary gas turbines.

SUMMARY OF THE INVENTION

Briefly, the present invention discloses a nickel base alloy which provides simultaneously excellent environmental resistance, phase stability during diffusion heat treatment and during service, and highly improved thermomechanical behavior, and hence is particularly adapted for use as coating for advanced gas turbine blading. The alloy according to the present invention is prepared with the elements in an amount to provide an alloy composition as shown in Table 1 (a).

TABLE 1(a)

Range of Preferred Coating Compositions of Present Invention

| | Elements in wt % of composition | | | | | | | | | | | |
|---|---|---|---|---|---|---|---|---|---|---|---|---|
| | Ni | Co | Cr | Al | Y | Si | Ta | Re | Ca | Mg | Ru | La* |
| Coating | Bal. | 28–35 | 11–15 | 10–13 | 0.005–0.5 | 1–2 | 0.2–1 | 0–1 | 0–1 | 0–1 | 0–5 | 0–0.5 |

La* = La + elements from Lanthanide series
Y + La (+ La-series) ≦ 0.3–2.0 wt %
Si + Ta ≦ 2.5 wt %
Hf, C < 0.1 wt %
Ca + Mg > 2 × (S + 0)

It was found that the preferred alloys of Table 1 (b) exhibit a dramatically and unexpectedly high TMF resistance, while providing excellent environmental protection and phase stability during high temperature exposure.

TABLE 1(b)

| Preferred Coating Compositions | | | | | | | | | | |
|---|---|---|---|---|---|---|---|---|---|---|
| | Elements in wt % of composition | | | | | | | | | |
| Coating | Ni | Co | Cr | Al | Re | Y | Si | Ta | Ca | Mg |
| PC1 | Bal. | 29.7 | 12.9 | 11.5 | 0 | 0.27 | 1.2 | 0.5 | 0.003 | |
| PC2 | Bal. | 30.2 | 11.9 | 12.1 | 0.1 | 0.1 | 1.1 | 0.4 | | 0.001 |
| PC3 | Bal. | 32 | 13.1 | 10.9 | 0.2 | 0.25 | 1.3 | 0.5 | 0.005 | 0.001 |

Preferably, the alloy of the desired composition can be produced by the vacuum melt process in which powder particles are formed by inert gas atomization. The powder can then be deposited on a substrate using, for example, thermal spray methods. However, other methods of application may also be used. Heat treatment of the coating using appropriate times and temperatures is recommended to achieve a high sintered density of the coating and to promote bonding to the substrate.

Prior art coatings, such as EC0 in table 2 (a), are known to exhibit excellent oxidation/sulfidation resistance and good thermomechanical fatigue properties. However, as turbine inlet temperatures increase and turbine operating cycles become more severe (e.g. higher strain ranges, higher cooling rates, higher number of cycles), the cyclic life of protective coatings needs to be further improved.

In an effort to develop a coating with improved mechanical properties—without sacrificing too much oxidation resistance—a variety of alloy compositions was evaluated. In order to prove the advantage of the preferred compositions of table 1 (b) a number of additional alloys whose compositions are given in Table 2 have also been tested. Compared with the preferred compositions, alloys EC0–EC6 were found to have either reduced oxidation resistance or inferior mechanical properties. Only the alloy according to the invention provides simultaneously high oxidation resistance and thermomechanical fatigue resistance and phase stability.

TABLE 2(a)

| Prior Art Coating Composition | | | | | | | | |
|---|---|---|---|---|---|---|---|---|
| | Elements in wt % of composition | | | | | | | |
| Coating | Ni | Co | Cr | Al | Re | Y | Si | Ta |
| EC0 | Bal. | 24 | 13 | 11 | 3 | 0.3 | 1.2 | 0.5 |

TABLE 2(b)

| Additional Experimental Coating Compositions | | | | | | | | |
|---|---|---|---|---|---|---|---|---|
| | Elements in wt % of composition | | | | | | | |
| Coating | Ni | Co | Cr | Al | Re | Y | Si | Ta |
| EC1 | Bal. | 24 | 13 | 11 | — | 0.3 | 1.2 | 0.5 |
| EC2 | Bal. | 30 | 13 | 11 | 3 | 0.3 | 1.2 | 0.5 |
| EC3 | Bal. | 30 | 13 | 11 | 1.5 | 0.3 | 1.2 | 0.5 |
| EC4 | Bal. | 24 | 15 | 11 | 3 | 0.3 | 1.2 | 0.5 |

TABLE 2(b)-continued

| Additional Experimental Coating Compositions | | | | | | | | |
|---|---|---|---|---|---|---|---|---|
| | Elements in wt % of composition | | | | | | | |
| Coating | Ni | Co | Cr | Al | Re | Y | Si | Ta |
| EC5 | Bal. | 24 | 17 | 11 | — | 0.3 | 0.2 | — |
| EC6 | Bal. | 35 | 22 | 11 | — | 0.3 | — | — |

BRIEF DESCRIPTION OF THE DRAWINGS

FIG. 2 (*b*) shows a second chart of the equilibrium phase structures as predicted by computer modeling for the preferred coating composition.

DETAILED DESCRIPTION OF THE EMBODIMENT

In the practice of the invention, coatings with compositions according to the present invention were produced by low pressure plasma spraying. A typical nickel base superalloy of the type used in gas turbine engines, known as CMSX4 (CMSX=trademark of Cannon Muskegan Co) and having a nominal composition of 9.5% Co, 6.5% Cr, 5.6% Al, 6.4% W, 6.5% Ta, 0.5% Mo, 1% Ti, 0.1% Hf, balance Ni was used as substrate for testing. The coating compositions which have been tested, are given in tables 1 (b) and 2. The performance of the coatings was evaluated by means of (i) isothermal oxidation at 1000 and 1050° C. in a laboratory furnace, (ii) a water spray quench test and (iii) thermomechanical fatigue (TMF) testing at various upper temperature limits (800 to 1050° C.).

Figure 1:
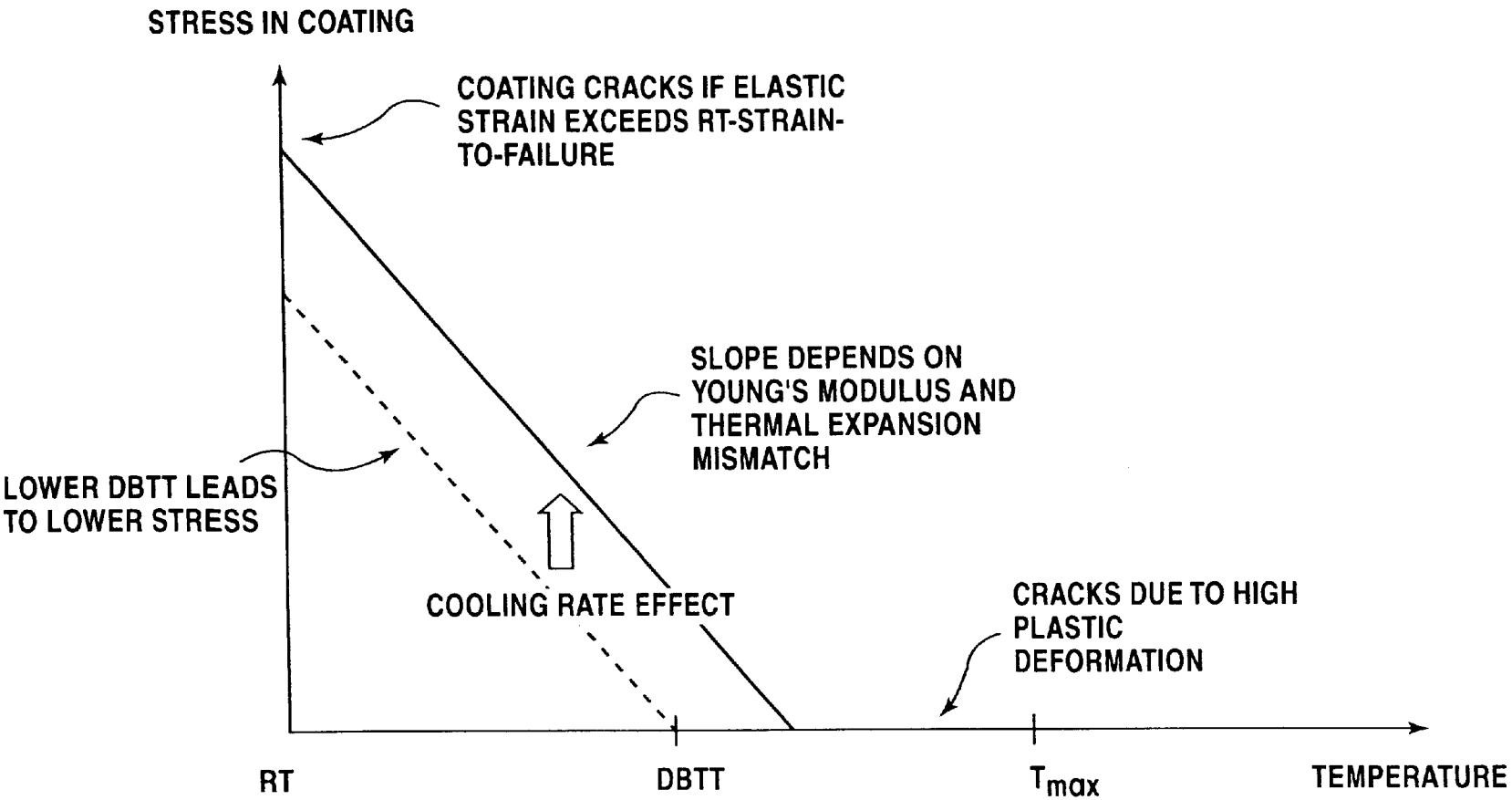
FIG. 1 is a graph which schematically shows how certain physical and mechanical coating properties determine the response of the coating to the cool-down cycle of a thermomechanical fatigue test.

It is known that essentially two failure mechanisms control the thermomechanical fatigue (TMF) behavior of coated articles. One failure mechanism occurs in the low temperature region when stress builds up in the coating upon cooling from high temperatures to below the ductile-brittle-transition temperature (DBTT). This could lead to spontaneous crack initiation and critical crack growth. The second failure mechanism occurs in the high temperature region when creep deformation, oxidation or potential phase transitions in the coating become dominant. The dependence of TMF behavior on certain physical and mechanical coating properties is schematically illustrated in FIG. 1.

Obviously, for good mechanical behavior over the whole temperature range of interest for turbine operation an advanced coating must have (i) a high enough room temperature (RT) ductility, (ii) a low enough ductile brittle transition temperature (DBTT) or a low enough Young's modulus, (iii) a thermal expansion coefficient similar to the substrate over the whole temperature range and (iv) a high temperature strength.

It must be understood that it is not sufficient to optimize any single coating property by itself to yield an optimized TIVIF life but it is necessary to vary the ensemble of all relevant physical and mechanical properties through phase composition and stability. While, for example, a low DBTT is beneficial, the coating may still crack upon cooling if the RT ductility is too low. Even in the case that a coating has a low DBTT and high RT ductility this can be overcompensated by high plastic deformations in the high temperature range. As a consequence, emphasis was here put on the evaluation of the overall thermomechanical performance of the alloy compositions of this invention.

The preferred alloy compositions and the alloy compositions of table 2 were tested in TMF tests which consist of cycling coated cylindrical hollow test specimens between room temperature and $T_{max}$, where $T_{max}$, was varied from 800 to 1100° C. The thermal cycle is superimposed by an applied mechanical strain in the "out of phase" mode. During the test the coated specimens were monitored for crack initiation and crack growth. The results of TMF testing at $T_{max}$=800° C. and $T_{max}$=1000° C. are shown in Table 3 (a) and (b), respectively.

In order to improve the TMF performance of the prior art coating EC0 cobalt, rhenium and chromium contents in the alloy were varied and their effects on TIVIF life investigated. From table 3 it is obvious that changing the rhenium content of the prior art coating (EC0) from 3 to 0 wt % (EC1) at the expense of nickel dramatically increased the TIVIF life of the coating at 800° C. (600% and change in crack mode from critical to subcritical) but had no effect on the TMF life at 1000° C. When the cobalt content of the prior art coating (EC0) was increased from 24 to 30 wt % (EC2) the TMF life at 800° C. was increased by 300% but the crack mode remained unchanged; the TMF life at 1000° C. was unchanged. When the rhenium and cobalt contents of the prior art coating (EC0) were changed simultaneously from 3 to 1.5% and 24 to 30%, respectively (EC3), it was observed that the TMF lives at 800° C. increased by 200% and mixed crack mode and at 1000° C. increased considerably by a factor of 1.8. When the rhenium and cobalt contents of the prior art coating (EC0) were further changed from 3 to 0% and 24 to 30%, respectively (preferential composition coating), the TMF lives at 800° C. and 1000° C. increased even further by 700% and 220%, respectively, and a subcritical crack mode was observed for both temperatures.

Unexpectedly, changing the chromium level in the prior art coating (EC0) from 13 to 15% (EC4) led to a significant reduction in TMF life. When the Cr content was increased from 13 to 17% and additionally the Re content decreased from 3 to 0% (EC6) compared to the prior art coating (EC0) the TMF life of EC6 at 800° C. increased by 300% (same critical crack mode) and at 1000° C. decreased to 80% of the prior art coating. Compared to coating EC1 the TMF life of EC6 at 1000° C. was lower.

TABLE 3

| Coating | TMF life (compared to EC0) | Characteristics of crack growth |
|---|---|---|
| Behavior of selected coatings in TMF test at $T_{max}$ = 800° C. | | |
| EC0 | 100% | Critical |
| EC1 | 600% | Subcritical |
| EC2 | 300% | Critical |
| EC3 | 200% | critical/subcritical |
| EC4 | 50% | Critical |
| EC5 | 300% | Critical |

TABLE 3-continued

| Coating | TMF life (compared to EC0) | Characteristics of crack growth |
|---|---|---|
| Preferred coating Composition | 700% | Subcritical |
| Behavior of selected coatings in TMF test at $T_{max}$ = 1000° C. | | |
| EC0 | 100% | subcritical |
| EC1 | 100% | subcritical |
| EC2 | 100% | subcritical |
| EC3 | 180% | subcritical |
| EC4 | 100% | critical/subcritical |
| EC5 | 80% | critical/subcritical |
| Preferred Coating Composition | 220% | subcritical |

The performance of the preferred and experimental compositions was also evaluated by means of a water spray quench test. It consists of heating a coated article (e.g. airfoil) to temperatures between 800 and 1100° C., holding the article at this temperature for time periods between 15 and 60 minutes and then quenching the article to room temperature with a water spray. The difference between TMF and water spray quench test is that the former is carried out on specifically produced specimens whereas gas turbine components coated under serial production type conditions are used for the latter test. The tested articles are evaluated for appearance of cracks and coating chips. The results which have been summarized in Table 4 also show the superior performance of the preferred coating composition.

TABLE 4

Life of selected coatings in water spray quench test

| Coating | Life in water spray quench test |
|---|---|
| EC0 | 100% |
| EC1 | 400% |
| EC2 | 50% |
| EC3 | 200% |
| EC5 | 20% |
| Preferred coating composition | >500% |

Figure 2A:
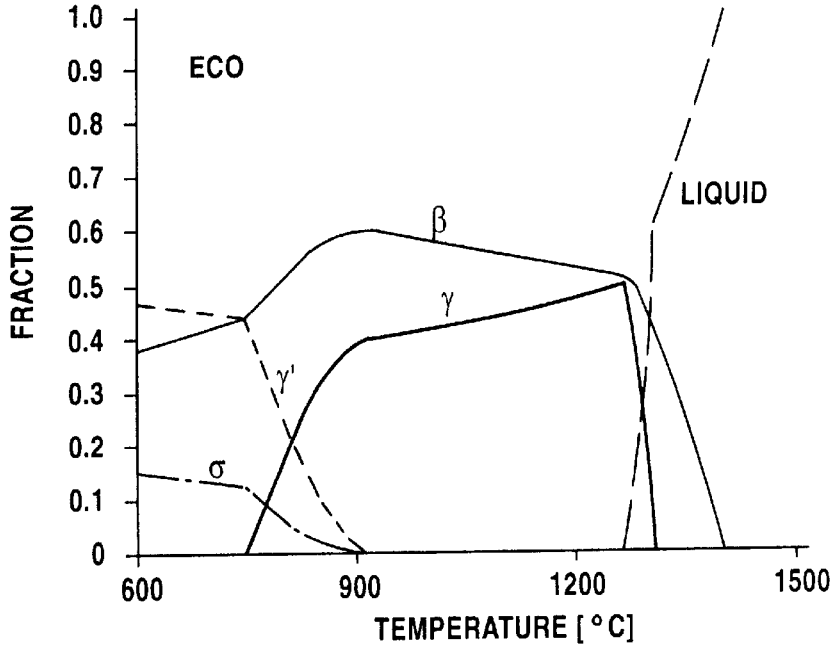
FIG. 2 (*a*) shows a first chart of the equilibrium phase structures as predicted by computer modeling for the prior art coating ECO.
Figure 2B:
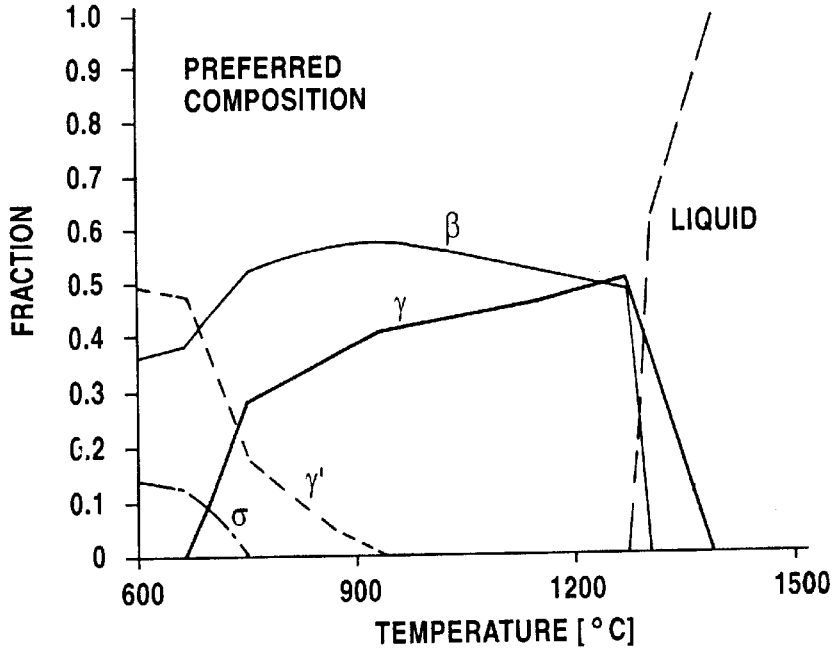

It was found that when the prior art coating EC0 was operated at intermediate temperatures (between 850 and 900° C.) phase transformation to sigma phase took place. It is believed that these precipitates contribute towards to the observed TIVIF performance. Computer modeling with THERMOCALC revealed for EC0 (FIG. 2(*a*)) that sigma-phase becomes thermodynamically stable below about 900° C. Thermodynamic modeling of the preferred coating composition in FIG. 2(*b*) indicates that the sigma-phase stability temperature is decreased to below 750° C. It is expected that the actual sigma-phase precipitation reaction at temperatures below 750° C. is kinetically suppressed.

It is known that the corrosion resistance of the alloy is determined mainly by the Cr content in the alloy. Low Cr levels (<11%) result not only in low corrosion resistance, but also in a lower Al activity and hence, lower oxidation resistance. The Al activity increases significantly if the Cr level is >11%. Too high a Cr level, particularly in γ-β coatings with a relatively high Al content, however, significantly reduces low temperature ductility and fatigue life. At Cr levels exceeding 15 wt %, γ and β phases transform to α-Cr and γ' during service operation, resulting in a totally brittle phase structure.

It is also known that the oxidation resistance of MCrAlY compositions is determined mainly by their Al content, i.e. by the reservoir of Al atoms to form a protective $Al_2O_3$ scale, and by the activity of Al in the system. The activity of Al is strongly influenced by the presence of other elements in the alloy and by the alloy phase structure which determines Al-diffusion. Upon oxidation a protective alumina scale grows on the alloy thereby depleting the alloy of aluminum. When the oxide scale reaches a certain critical thickness it will spall and a new alumina scale will grow. This procedure will continue until aluminum depletion in the coating has proceeded to such an extent that a continuous protective scale will no longer form. This state is typically referred to as the end of oxidation life of the coating. Obviously, the oxidation life of the coating depends on the growth characteristics of the alumina scale (i.e. kp value) and the Al reservoir/activity in the alloy.

Figure 3:
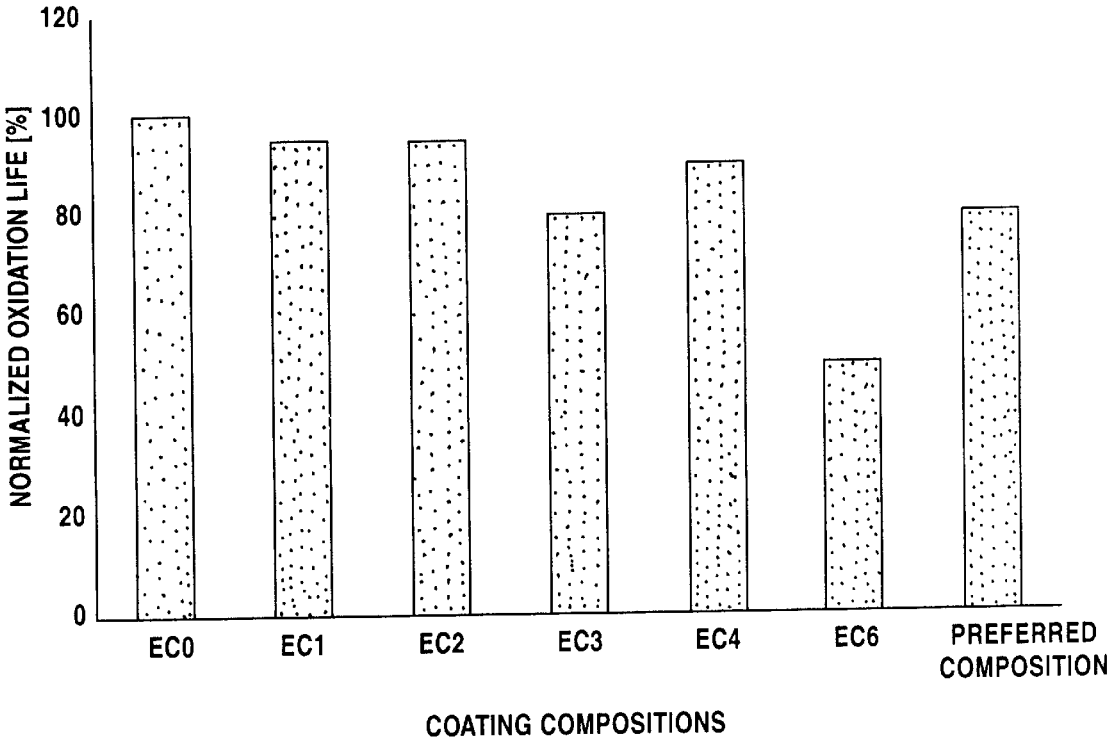
FIG. 3 shows in the form of a bar chart the oxidation life of the preferred coating and experimental coatings EC1–EC6 compared to the prior art coating EC0.

The environmental resistance of the alloy compositions of tables 1 (b) and 2 was evaluated by means of isothermal oxidation at 1000 and 1050° C. in a laboratory furnace. Presented in FIG. 3 are experimental data which show the oxidation lives of the preferred and experimental alloy compositions after oxidation at 1050° C. All data have been normalized with respect to EC0, the prior art coating composition. (It should be noted that testing at 1000° C. yields the same ranking as testing at 1050° C. but requires longer testing times.) Surprisingly, coating EC6 (increased cobalt and chromium content, no rhenium compared to ECO) showed poor oxidation resistance which yielded 50% reduction in life compared to prior art coating EC0 which is not acceptable. The figure clearly illustrates that the oxidation life of the preferred coating compositions decreased by 20% compared to EC0, which is an acceptable sacrifice in environmental resistance yet a dramatic improvement in thermomechanical properties.

It is important to understand that only the combination of the elements claimed in Table 1 results in the desirable and stable β+γ phase structure (in the requested phase proportions) with excellent oxidation/corrosion resistance and excellent mechanical properties. The excess of alloying elements, such as Cr, Al, Ta, Si, Re, results in the precipitation of detrimental σ-, Heusler-, or r-phases.

Lower than the specified levels of Al, Cr, and Si lead to reduced oxidation and/or corrosion resistance and increases the rate of oxide growth, and hence, should be avoided in case that the coating is to be used as a TBC bond coat.

Typically, MCrAlY coatings contain 0.5 to 1 wt % Y which has a powerful effect on the oxidation resistance of the alloy. In some fashion, Y acts to improve the adherence of the oxide scale which forms on the coating, thereby substantially reducing spallation. A variety of other so-called oxygen active elements (La, Ce, Zr, Hf, Si) have been proposed to replace or supplement the Y content. In the present invention Y is added in amounts on the order of 0.005 to 0.5 wt %, La and elements from the Lanthanide series in amounts ranging from 0 to 0.5 wt %.

The presence of Si in the alloy increases the activity of Al and, thus, its oxidation resistance. Si contents >2.5 wt %, however, must be avoided in order to prevent precipitation of brittle Ni (Ta, Si) phases. The beneficial role of Ta on oxidation performance, particularly when combined with Si, is known, however, computer modeling of the phase structure shows that in order to avoid embrittlement of the coating the combined content of (Si+Ta) must not exceed 2.5 wt %. In the present invention Ta is added in amounts ranging from 0.2 to 1%.

The beneficial role of Ca and Mg on oxidation resistance is related to their ability to react with sulphur and oxygen and form stable and inert reaction products. However, higher than specified amounts of Ca and Mg should be avoided to avoid increasing oxidation rates.

We claim:

1. A coating composition for superalloy structural parts, including gas turbine vanes and blades, comprising in wt %:

| | |
|---|---|
| Ni | balance to 100% |
| Co | 28–35 |
| Cr | 11–15 |
| Al | 10–13 |
| Re | 0–1 |
| Si | 1–2 |
| Ta | 0.2–1 |
| Y | 0.005–0.5 |
| Ru | 0–5 |
| Ca | 0–1 |
| Mg | 0.001–1 |
| La + La-series | 0–0.5 |
| B | 0–0.1 |
| Hf | <0.1 |
| C | <0.1 |
| where: Y + La (+ La-series) | 0.3 – [2.0] 1.0 |
| Si + Ta | ≦2.5 |
| Ca + Mg | >2 (S + O) |

2. The coating composition of claim 1 comprising in wt %

| | |
|---|---|
| Ni | balance |
| Co | 29.7 |
| Cr | 12.9 |
| Al | 11.5 |
| Re | 0 |
| Si | 1.2 |
| Y | 0.27 |
| Ta | 0.5 |
| Ca | 0.003 |
| Hf, C | <0.1. |

3. The coating composition of claim 1 comprising in wt %

| | |
|---|---|
| Ni | balance |
| Co | 30.2 |
| Cr | 11.9 |
| Al | 12.1 |
| Re | 0.1 |
| Si | 1.1 |
| Y | 0.1 |
| Ta | 0.4 |
| Mg | 0.01 |
| Hf, C | <0.1. |

4. The coating composition of claim 1 comprising in wt %

| | |
|---|---|
| Ni | balance |
| Co | 32 |
| Cr | 13.1 |
| Al | 10.9 |
| Re | 0.2 |
| Si | 1.3 |
| Y | 0.25 |
| Ta | 0.5 |
| Ca | 0.005 |
| Mg | 0.001 |
| C, B | <0.1. |

5. The coating composition of claim 1 comprising a phase structure of ductile γ matrix containing β precipitates being beneficial for oxidation/corrosion resistance and mechanical behavior.

6. The coating composition according to claim 1 being deposited as a layer on a substrate selected from the group consisting of Ni-base and Co-base superalloys.

7. The coating composition according to at least one of the preceding claims being deposited as a layer on a substrate and provided with a top layer of a thermal barrier coating of said coating composition.

8. A coating composition for superalloy structural parts, consisting essentially of: cobalt, 28–35% by weight; chromium, 11–15% by weight; aluminum, 10–13% by weight; silicon, 1–2% by weight; tantalum, 0.2–1% by weight, provided that the combined amounts of silicon and tantalum do not exceed 2.5% by weight; yttrium, 0.005–0.5% by weight; a lanthanide series element, 0–0.5% by weight, provided that the combined amounts of yttrium and lanthanide series element are 0.3–1.0% by weight; rhenium, 0–1% by weight; ruthenium, 0–5% by weight; calcium, 0–1% by weight; magnesium, 0.001–1% by weight, provided that the combined amounts of calcium and magnesium are at least 2 times the combined amounts of sulfur and oxygen; boron, 0–1% by weight; hafnium, less than 0.1% by weight; carbon, less than 0.1% by weight, and the balance to 100% by weight nickel and incidental impurities.

9. The coating composition according to claim 8, comprising in wt %:

| | |
|---|---|
| Ni | balance |
| Co | 29.7 |
| Cr | 12.9 |
| Al | 11.5 |
| Re | 0 |
| Si | 1.2 |
| Y | 0.27 |
| Ta | 0.5 |
| Ca | 0.003 |
| Hf, C | <0.1. |

10. The coating composition according to claim 8, comprising in wt %:

| | |
|---|---|
| Ni | balance |
| Co | 30.2 |
| Cr | 11.9 |
| Al | 12.1 |
| Re | 0.1 |
| Si | 1.1 |
| Y | 0.1 |
| Ta | 0.4 |
| Mg | 0.01 |
| Hf, C | <0.1. |

11. The coating composition according to claim 8, comprising in wt %:

| | |
|---|---|
| Ni | balance |
| Co | 32 |
| Cr | 13.1 |
| Al | 10.9 |
| Re | 0.2 |
| Si | 1.3 |
| Y | 0.25 |
| Ta | 0.5 |
| Ca | 0.005 |
| Mg | 0.001 |
| C, B | <0.1. |

12. The coating composition according to claim 8, comprising a phase structure of ductile γ matrix containing β precipitates being beneficial for oxidation/corrosion resistance and mechanical behavior.

13. The coating composition according to claim 8 as a layer on a substrate selected from the group consisting of Ni-base and Co-base superalloys.

14. The coating composition according to claim 8 as a layer on a substrate and further provided with a top layer of a thermal barrier coating.

* * * * *